US006053373A

United States Patent [19]

Sutton et al.

[11] Patent Number: 6,053,373

[45] Date of Patent: Apr. 25, 2000

[54] FLUID DISPENSING DEVICE

[75] Inventors: Charles L. Sutton, Eureka; Daniel L Durbin, Ballwin, both of Mo.

[73] Assignee: S.C. Johnson Commercial Markets, Inc., Sturtevant, Wis.

[21] Appl. No.: 09/173,868

[22] Filed: Oct. 16, 1998

[51] Int. Cl.[7] ..... B67D 5/00

[52] U.S. Cl. ..... 222/402.13; 222/402.15; 222/529; 141/20

[58] Field of Search ..... 141/2, 3, 18, 20–23; 222/402.12, 402.13, 402.15, 402.21, 402.22, 402.23, 529

[56] References Cited

U.S. PATENT DOCUMENTS

| | | | |
|---|---|---|---|
| 2,773,521 | 12/1956 | Persson . | |
| 3,007,613 | 11/1961 | Tygard | 222/402.15 |
| 3,134,407 | 5/1964 | Wegman . | |
| 3,303,970 | 2/1967 | Breslau et al. | 222/402.15 |
| 3,343,718 | 9/1967 | Siegel et al. . | |
| 3,853,157 | 12/1974 | Madaio | 141/2 |
| 4,660,745 | 4/1987 | Hess, Jr. | 222/402.15 |
| 4,671,431 | 6/1987 | Obrist | 222/402.15 |
| 4,895,190 | 1/1990 | Gillen . | |
| 5,147,075 | 9/1992 | Regan | 222/402.15 |
| 5,154,323 | 10/1992 | Query et al. | 222/402.13 |
| 5,335,703 | 8/1994 | deJong . | |
| 5,348,059 | 9/1994 | Carroll . | |
| 5,462,101 | 10/1995 | Mouchmouchian . | |
| 5,472,022 | 12/1995 | Michel et al. . | |
| 5,511,692 | 4/1996 | Willingham . | |
| 5,531,254 | 7/1996 | Rosenbach . | |
| 5,607,003 | 3/1997 | Gray . | |
| 5,651,397 | 7/1997 | Black et al. . | |
| 5,702,036 | 12/1997 | Ferrara, Jr. | 222/402.13 |

*Primary Examiner*—J. Casimer Jacyna
*Attorney, Agent, or Firm*—Warren R. Bovee; Neil E. Hamilton

[57] ABSTRACT

A device is disclosed for delivering insecticidal gel and other fluids from an aerosol can. The device has a first arm that docks to the aerosol can top. A second arm pivots relative to the first arm and has an adaptor tube that deflects the valve and forms a leak-proof connection channel for product being delivered from the can. The tube can alternatively be connected to a piston type tube (to refill it), or it can be linked to a delivery straw to directly deliver the fluid.

9 Claims, 2 Drawing Sheets

FLUID DISPENSING DEVICE

CROSS REFERENCES TO RELATED APPLICATIONS

Not Applicable

STATEMENT REGARDING FEDERALLY SPONSORED RESEARCH

Not Applicable

BACKGROUND OF THE INVENTION

The invention relates to an apparatus for refilling piston delivery tubes from aerosol cans. It can also be used to deliver material directly from such cans.

Insecticide has previously been applied along seams between walls and in small cracks using piston tubes. The pistons in these tubes drive an insecticide out a nozzle end of the tube (somewhat like a syringe or a caulk tube). Various devices exist to drive a stem against such pistons to cause this to happen.

Consumers have no inexpensive, efficient, and safe way to refill these tubes. While there is equipment that is used to fill these tubes from their nozzle end at a factory, it is too expensive for consumers to use for refill purposes. Thus, once these piston tubes are emptied they are typically thrown away. This a waste of material (which increases the cost of using them), and it leads to contaminated garbage.

A related problem is that consumers often have no good way to deliver insecticides directly from an aerosol can to narrow crevices. While straws have been inserted into spray outlets of aerosol cans to direct spray to particular points (e.g. to deliver lubricants to machine parts), the joint between the straw and the aerosol can outlet is often susceptible to leakage. In any event the user may be exposed to the contents of the can as the straw is being inserted directly into the can's outlet.

Analogous problems exist in connection with delivering other types of fluids from pressurized cans to narrow crevices. As such, it can be seen that a need exists for improved fluid delivery systems.

BRIEF SUMMARY OF THE INVENTION

In one aspect the invention provides a device for dispensing a fluid from a pressurized container that has an outlet valve that is actuated by deflection. The device has a first arm member connectable to the container adjacent the outlet valve. There is also a second arm member pivotally attached to the first arm member.

An adaptor tube is connected to the second arm member to pivot therewith. The first and second arm members and the adaptor tube are juxtaposed so as to cause a deflection of the outlet valve when the first arm is connected to the container and the second arm is pivoted towards the first arm. Here, "deflection" is intended to mean downward and/or sideways movement.

In a preferred form there is a threaded adjustment screw connected to the second arm member for adjustably limiting how close a free end of the first arm may swing towards a free end of the second arm. This determines how quickly fluid is delivered. Alternatively, the adjustment screw can be located on the first arm (or elsewhere in the device).

A preferred type of container is a standard aerosol can, such as one obtainable from U.S. Can that has a valve at its upper end that will permit product to exit the can when the outlet valve is downwardly deflected.

The term "fluid" is used herein in its broadest sense, including, without limitation, liquid, gels, foams, and gases) that can be flowably released from a pressurized aerosol can. A preferred fluid is the insecticidal gel sold by Whitmire-Microgen under the brand name Avert®.

The preferred adaptor tube of the present invention includes a recess at one end for mating with the can's valve. The recess is linked to an axial conduit that runs up through the tube. The conduit exits at an opposite end of the adaptor where there are means for facilitating a connection to an applicator.

The connection means may be external threads designed to mate with internal threads of an applicator. Other systems such as bayonet connections, slot and groove connections, and the like can be used.

The most preferred applicator is a syringe like tube having a slidable piston that rides in an internal cavity. The tube is designed to be refilled from its lower end. When its contents are used up, a consumer may use the device of the present invention to refill it from an aerosol can.

Alternatively, the outlet of the adapter can be a connection means when the applicator is a straw. In this version, the device is a delivery gun.

The aerosol can preferably has a raised inwardly projecting ring (with an undercut) surrounding the upper outlet valve. The first arm member has a docking collar suitable to provide a snap fit engagement with this ring. In this regard, the docking collar may be an integral portion of the first arm, or it may be a separate insert. In either case, it can be a plastic ring that is split at two points so as to permit inward flexing of the collar.

In another aspect the invention provides methods of delivering a fluid, such as an insecticide, using the above device.

The objects of the present invention therefore include providing fluid dispensing devices of the above kind which:

(a) permit consumers to refill piston tubes from aerosol cans;

(b) permit an aerosol can to be incorporated into a fluid delivery gun;

(c) are relatively inexpensive to produce and easy to use; and (d) permit controlled amounts of fluids to be delivered to narrow crevices from an aerosol can. These and still other objects and advantages of the present invention (e.g. methods for using such devices) will be apparent from the descriptions which follows. The following descriptions are merely of the preferred embodiments.

DETAILED DESCRIPTION

Figure 1:
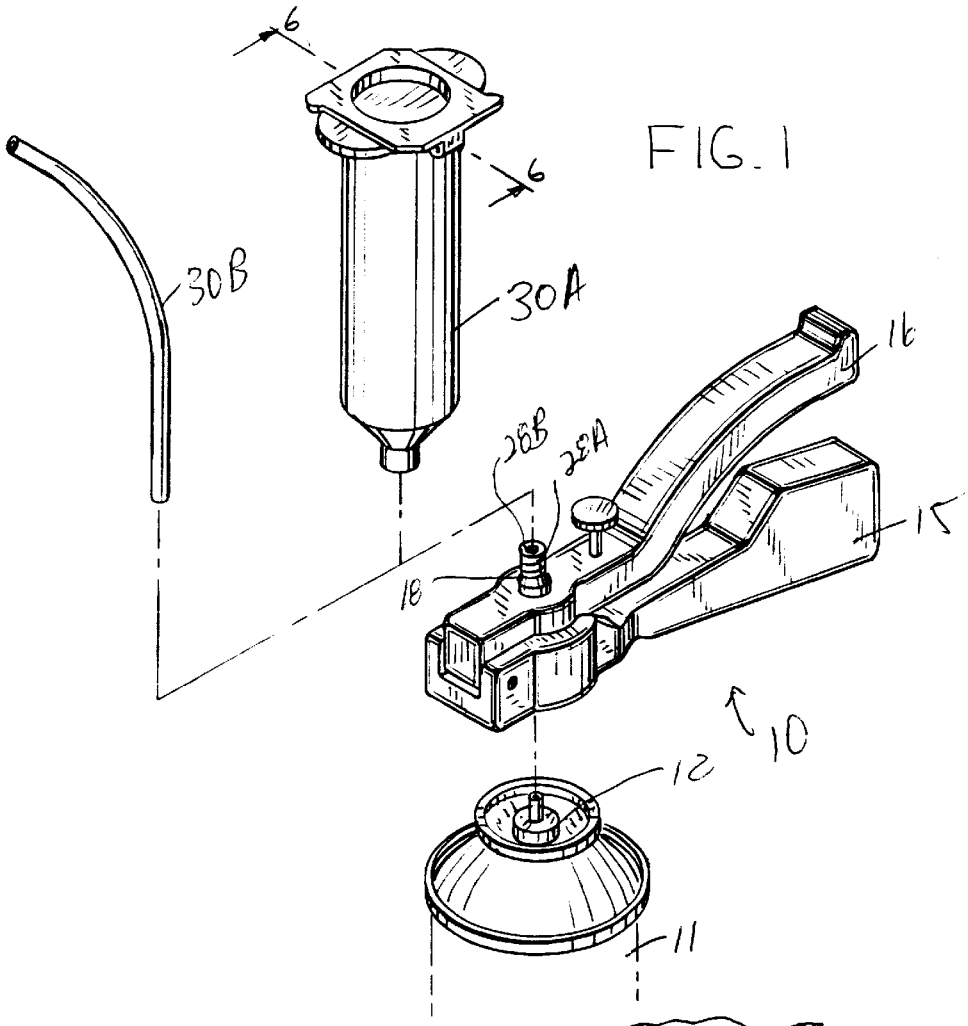
FIG. 1 is an exploded perspective view of a dispensing device of the present invention shown adjacent to an aerosol can top (and also showing two alternative forms of the device's applicators)

The invention provides a device (generally 10) for dispensing a fluid from a pressurized container 11. The can has an outlet valve 12 that is actuated by deflection thereof. The can also has a docking ridge 41 at its upper edge.

A nutcracker like construction is formed by a first arm member 15 and a second arm member 16. The first arm member 15 is connectable at its lower end to the container 11 via an inwardly deflectable docking collar 40 that can snap fit into and under ridge 41.

Figure 5:
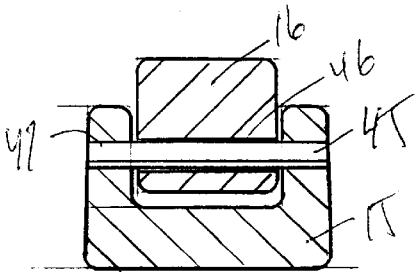
FIG. 5 is a view taken along line 5—5 of FIG. 2.

Second arm 16 is pivotably attached to the first arm member 15. As shown at FIG. 5, this is achieved via first arm 15 being provided with a pintle 45 that is supported in holes 47 in a jam fit fashion. Second arm 16 has a tubular hole that loosely receives the pintle 45. This provides a pivotable connection in which the second arm 16 can pivot around the pintle 45. A free end of the second arm 16 (the end opposite the pivoting pintle) can thus swing towards and away from a free end of the first arm 15 (again the end opposite the pivoting pintle).

Adaptor tube 18 is tightly wedged into the second arm 16 so as to move therewith. It has a central channel 19, a lower recess 26, and an upper end with connecting means 28A/28B.

Figure 2:
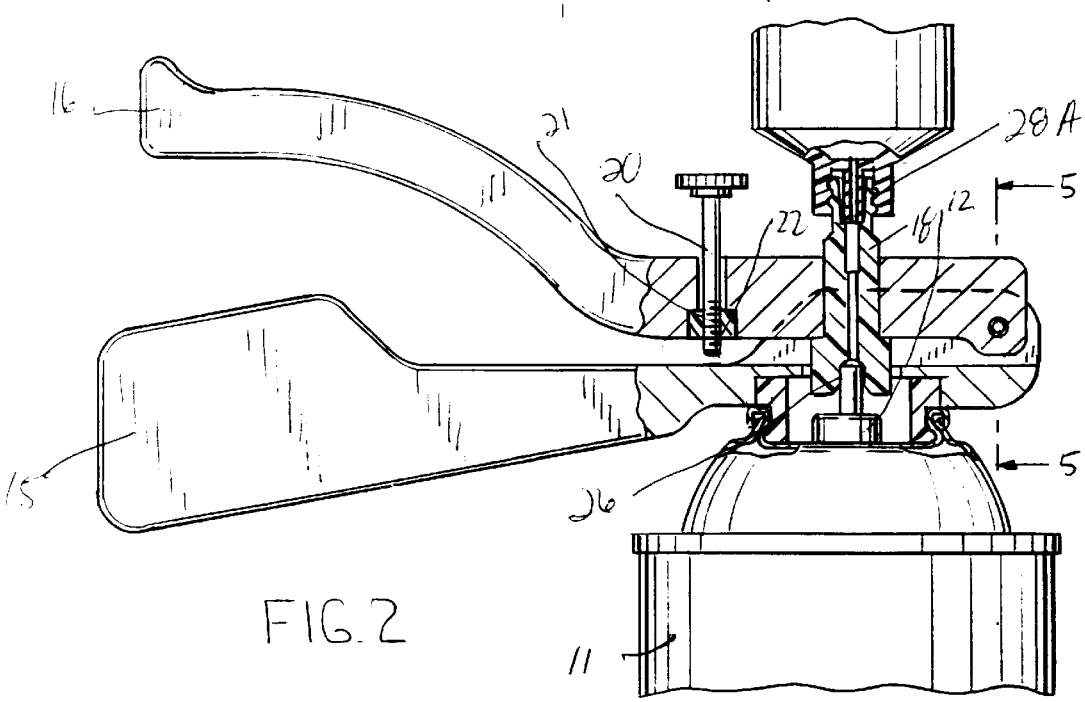
FIG. 2 is a fragmented vertical sectional view of an assembled dispensing device, with a piston tube applicator being used, and with the device being shown in a non-dispensing mode.
Figure 3:
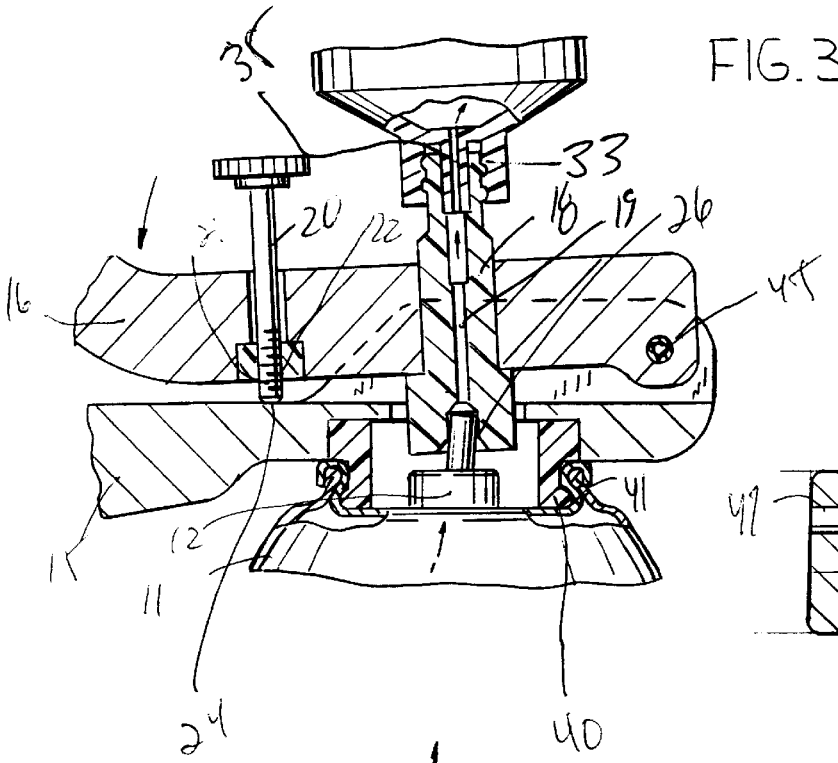
FIG. 3 is a view similar to FIG. 2, but with the arms of the device shown pressed closer together so as to cause the device to dispense fluid.

It should be appreciated by comparing FIGS. 2 and 3 that as arm 16 is pressed further downward towards arm 15, this affects a deflection of outlet valve 12. The deflection releases the contents of the aerosol can 11 up into channel 19, and then into either a piston tube 30A or a dispensing straw 30B.

An adjustment screw 20 is connected to the second arm 16 via outer threads 21 on the screw and inner threads 22 on the arm 16. By turning the screw one moves it up or down relative to the second arm 16, thereby changing the amount of screw extending below arm 16. This changes the amount of deflection of the valve 12 that movement of arm 16 can cause. This in turn controls the rate at which the contents of the can are dispensed.

In this regard, the bottom of the screw 20 can abut against the top of arm 15, at point 24. This limits the downward motion of arm 16.

The internal cavity 26 has generally vertical side walls. However, at the lower portion of the cavity there is some outward tapering.

Figure 6:
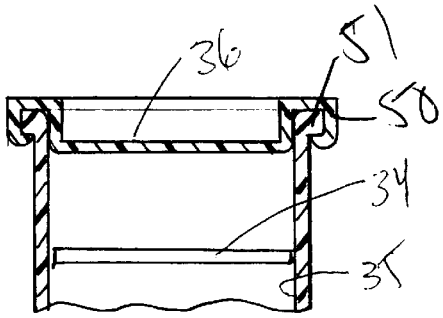
FIG. 6 is a view taken along line 6—6 of FIG. 1.
Figure 4:
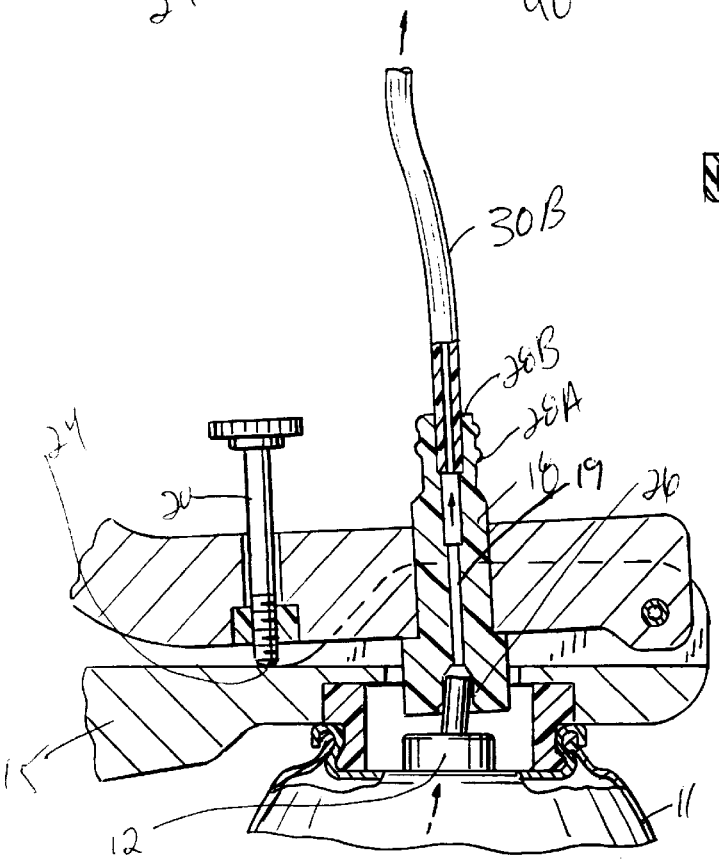
FIG. 4 is a view similar to FIG. 3, but with a straw applicator being shown in place of the piston tube applicator.

When piston tube 30A is used it is threaded onto the threads 28A of the adaptor tube via internal threads 33 on the bottom of the piston tube 30A. Assuming that there is an empty tube in FIG. 2, a piston 34 in the tube (see FIG. 6) would then be positioned relatively low in the tube 30A. As insecticidal gel or other fluid is released from the can (see FIG. 3), the gel is forced up into the piston tube through the conduit 35 and drives the piston 34 back up to the FIG. 6 "near fill" position. This provides a way for a consumer to refill a piston tube with little risk of contacting the fluid. During this filling process a removable snap cap 50 is preferably snapped over upper ridge 51 on tube 30A. This prevents the piston from being blown out the top of the tube 30A during filling.

Once filled, tube 30A can be screwed off the adaptor tube 18 and inserted in a caulking type gun (not shown). Another device which drives a stem into a tube end (once the cap 36 has been removed) can alternatively be used to squeeze a bead or line of fluid out of the bottom of the tube 30A.

Alternatively, straw 30B can be inserted into connector means 28B (the outlet of the adaptor 18). Using the arm 16 like a gun trigger, the device can then operates as a delivery gun (with the straw 30 being the "barrel" of the gun). This embodiment can deliver insecticidal gel into small cracks.

While preferred embodiments of the present invention have been described above, other alternatives are intended to be within the scope of the invention. For example, there need not be an adjustment screw and the fluid in the can may be a foam rather than a gel. The claims should therefore be looked to in order to determine the full scope of the invention.

Industrial Applicability

The present invention provides means for delivering fluids to narrow crevices, particularly via refilling piston tubes that are used for such purposes.

What is claimed is:

1. A device for dispensing a fluid from a pressurized container, the container being of the type having an outlet valve actuated by the deflection thereof, the device comprising:

a first arm member connectable to the container adjacent the outlet valve;

a second arm member pivotally attached to the first arm member, both of the arms extending laterally from the container; and an adaptor tube connected to the second arm member to pivot therewith;

wherein the first and second arm member and the adaptor tube are constructed and arranged so as to be able to effect a deflection of the outlet valve when the first arm is connected to the container and the second arm is pivoted towards the first arm.

2. The fluid dispensing device of claim 1, further comprising a threaded adjustment screw connected to the second arm member for adjustably limiting how close a free end of the first arm may swing towards a free end of the second arm.

3. The fluid dispensing device of claim 1, wherein the adaptor tube includes a recess at one end for mating with the valve member and means at an opposite end of the adaptor tube for connection to an applicator.

4. The fluid dispensing device of claim 3, wherein the device further comprises the applicator.

5. The fluid dispensing device of claim 4, wherein the applicator is a tube having a slidable piston that rides in a cavity of the tube.

6. The fluid dispensing device of claim 4, wherein the applicator is a straw.

7. The fluid dispensing device of claim 1, wherein the first arm member includes a radially inwardly deflectable docking collar.

8. A method of delivering a fluid, comprising the steps of:

docking the claim 1 device to a pressurized container containing a fluid, wherein the container is of a type that delivers the fluid through an outlet valve upon deflection of the valve; and pivoting the second arm of the claim 1 device towards the first arm of the claim 1 device so that the device deflects the outlet valve and causes the fluid to be delivered through the adaptor tube.

9. The method of claim 8, wherein the fluid is an insecticidal gel.

* * * * *